US009383116B2

(12) United States Patent
Lee

(10) Patent No.: US 9,383,116 B2
(45) Date of Patent: Jul. 5, 2016

(54) DEHUMIDIFICATION APPARATUS, AND AIR CONDITIONING APPARATUS AND AIR CONDITIONING SYSTEM HAVING THE SAME

(75) Inventor: Dae-Young Lee, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 602 days.

(21) Appl. No.: 11/743,109

(22) Filed: May 1, 2007

(65) Prior Publication Data

US 2008/0083232 A1 Apr. 10, 2008

(30) Foreign Application Priority Data

Oct. 9, 2006 (KR) ..... 10-2006-0098151

(51) Int. Cl.
*F25D 17/06* (2006.01)
*F24F 3/14* (2006.01)

(52) U.S. Cl.
CPC ..... *F24F 3/1429* (2013.01); *F24F 3/1423* (2013.01); *F24F 2203/1032* (2013.01); *F24F 2203/1056* (2013.01); *F24F 2203/1068* (2013.01); *F24F 2203/1084* (2013.01)

(58) Field of Classification Search
CPC ..... F24F 3/1423; F24F 3/1429; F24F 2203/1032; F24F 2203/1068; F24F 2203/1084; F24F 2203/1056
USPC ..... 62/94, 271
See application file for complete search history.

(56) References Cited

U.S. PATENT DOCUMENTS

| | | | | | |
|---|---|---|---|---|---|
| 3,965,695 | A | * | 6/1976 | Rush et al. | 62/271 |
| 4,786,301 | A | * | 11/1988 | Rhodes | 62/271 |
| 5,579,647 | A | * | 12/1996 | Calton et al. | 62/94 |
| 5,782,104 | A | * | 7/1998 | Sami et al. | 62/271 |
| 5,980,615 | A | * | 11/1999 | Roe | B01D 53/0415 96/111 |
| 6,029,467 | A | * | 2/2000 | Moratalla | 62/271 |
| RE37,464 | E | * | 12/2001 | Meckler | 62/93 |
| 2003/0074913 | A1 | * | 4/2003 | Ebara | 62/271 |

FOREIGN PATENT DOCUMENTS

KR 1020040016050 2/2004

* cited by examiner

*Primary Examiner* — Mohammad M Ali
(74) *Attorney, Agent, or Firm* — NSIP Law

(57) ABSTRACT

Disclosed are a dehumidification apparatus, and an air conditioning apparatus and system having the same. The dehumidification apparatus includes: a desiccant rotor having a desiccant for adsorbing moisture; and a regeneration unit disposed at one side of the desiccant rotor, for desorbing the moisture adsorbed to the desiccant. The regeneration unit includes at least one of a hollow hot water line containing hot water exchanging heat with the air flowing toward the desiccant rotor. The dehumidification apparatus efficiently reproduces the desiccant for dehumidification and air conditioning.

7 Claims, 6 Drawing Sheets

DEHUMIDIFICATION APPARATUS, AND AIR CONDITIONING APPARATUS AND AIR CONDITIONING SYSTEM HAVING THE SAME

RELATED APPLICATION

The present disclosure relates to subject matter contained in priority Korean Application No. 10-2006-0098151, filed on Oct. 9, 2006, which is herein expressly incorporated by reference in its entirety.

BACKGROUND OF THE INVENTION

1. Field of the Invention

The present invention relates to air conditioning, and more particularly, to a dehumidification apparatus for removing moisture from the air and lowering a temperature of the air, and an air conditioning apparatus and system having the same.

2. Description of the Background Art

Air conditioning is to keep temperature, humidity, air stream, bacteria, dust and harmful gas in the best conditions for persons or objects indoors. The representative air conditioning functions include cooling and heating relating to temperature control, and dehumidification and humidification relating to humidity control.

In addition to electricity generation, the cogeneration supplies heat to district heating or industrial processing by using the waste heat from the electricity generation process.

FIG. 1 is a concept view illustrating a heating process of houses by cogeneration.

Waste heat discarded from the process of electricity generation of a cogeneration plant 10 is stored in a thermal storage tank 11, and transferred to a liquid (water) flowing in a heat transfer line 14 through a heat exchanger 12 by a circulation pump 13. The resulting hot water is transferred to a cooling/heating system 20 of the houses.

A heat exchanger 21 of the cooling/heating system 20 exchanges heat between the hot water and the water circulating in a hot water circuit 22. Then, the hot water is supplied to the houses in response to demand in the houses.

Since the production ratio of power to heat is fixed to about 3:4, it is advantageous if the ratio of demands for power and heat is close to the production ratio. However, the demands for power and heat from commercial or residential sectors show very different patterns from each other in annual variation.

The demand for power has a maximum value in summer with a relatively small annual fluctuation, while the demand for heat has a large fluctuation with a maximum value in winter. According to a statistical review, the ratio of the minimum to the maximum in the annual heat demand is only 8.7% in middle and high latitude regions.

FIG. 2 is an instance showing monthly heat/electricity supply from a district heating corporation.

As shown in FIG. 2, according to the demand for heat, the heat supply N2 from the district heating corporation has a minimum value from June to September, namely, a hot season. A particular point in the graph is that the electricity supply N1 becomes almost zero in the summer regardless of the increasing demand in the electricity in the summer. This is because the cogeneration stops in the summer and the small heat demand is sufficed by a dedicated boiler for heat supply. The reason for this is that the operation of the cogeneration is economically efficient and energy efficient as well only when the demand ratio between electricity and heat matches well with the production ratio, as mentioned previously. When the demand ratio deviates much from the production ratio, the operation of cogeneration becomes economically inefficient and the cogeneration process needs to be stopped.

As described above, the efficient operation of the cogeneration plant cannot be ensured in summer without increasing the demand for the waste heat generated as a byproduct from the electricity generation.

As shown in FIG. 1, in order to increase the demand for heat in summer, the district cooling has been devised applying an absorption type chiller 23 using the district heat as the heat source. However, the absorption type chiller 23 has a drawback in that the cooling performance of the chiller decreases considerably with a low temperature heat source such as the waste heat from the cogeneration plant 10. In addition, the cold water circuit 24 connected to the absorption type chiller 23 must be installed separately from the hot water circuit 22.

SUMMARY OF THE INVENTION

Therefore, an object of the present invention is to provide a desiccant cooling system using hot water as the heat source for the regeneration of the desiccant.

Another object of the present invention is to perform air conditioning including cooling and dehumidification.

To achieve these and other advantages and in accordance with the purpose of the present invention, as embodied and broadly described herein, there is provided a dehumidification apparatus, including: a desiccant rotor having a desiccant for adsorbing moisture; and a regeneration unit disposed at one side of the desiccant rotor, for desorbing the moisture adsorbed to the desiccant, wherein the regeneration unit comprises at least one of a hot water tube containing hot water exchanging heat with the air flowing toward the desiccant rotor.

According to the second embodiment of the present invention, there is provided an air conditioning apparatus, including: a casing enclosing first and second channels separated by a partition wall; a desiccant rotor rotatably installed across the partition wall to be placed crossing the channels, for adsorbing moisture from an air flowing into the first channel; and a regeneration unit configured to desorb the moisture adsorbed to the desiccant rotor, by heating an air flowing into the second channel toward the desiccant rotor.

According to the third embodiment of the present invention, there is provided an air conditioning apparatus, including, a first hollow casing having its inlet and outlet opened to be in communication with the outdoor air; a second hollow casing disposed in the first casing, for partitioning off the first casing into first and second channels in communication with each other; a partition wall formed in the second casing, for partitioning off the second casing into third and fourth channels in communication with each other; a desiccant rotor rotatably installed in the second casing to be placed crossing the adjacent first and fourth channels, for adsorbing moisture from an air flowing into the first channel; a regeneration unit disposed in the fourth channel, for desorbing the moisture adsorbed to the desiccant rotor, by heating an air flowing into the fourth channel; and a heat exchanger placed crossing the adjacent second and third channels, for exchanging heat between an air flowing in the second channel and the air flowing into the third channel through the desiccant rotor.

According to the fourth embodiment of the present invention, there is provided an air conditioning system, including, a dehumidification system having a desiccant for adsorbing moisture; and a hot water supply system in communication with the dehumidification system, for supplying hot water, and also supplying heat for regenerating the desiccant of the dehumidification system.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 1:
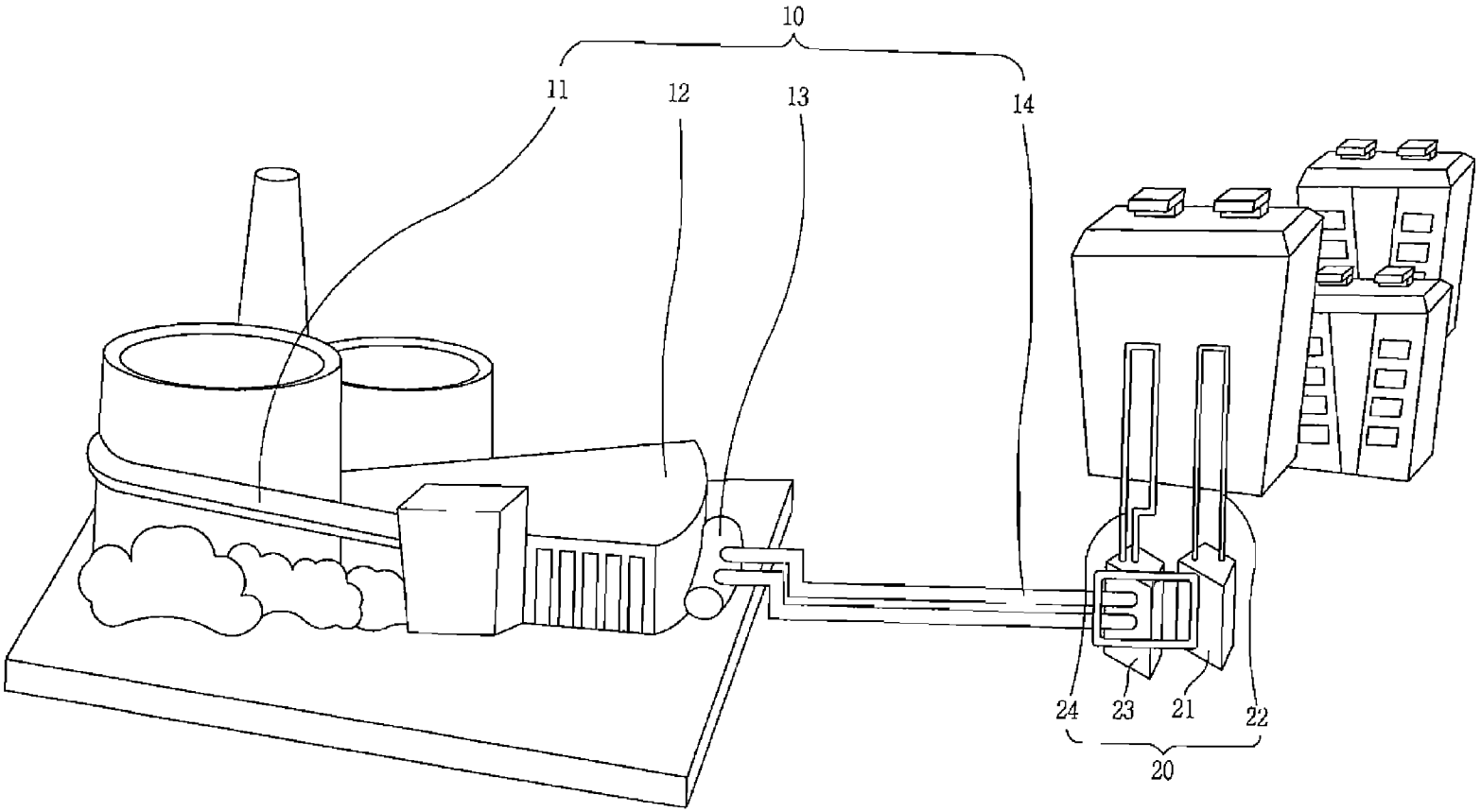
FIG. 1 RELATED ART
FIG. 1 is a concept view illustrating a heating process of houses by cogeneration.
Figure 2:
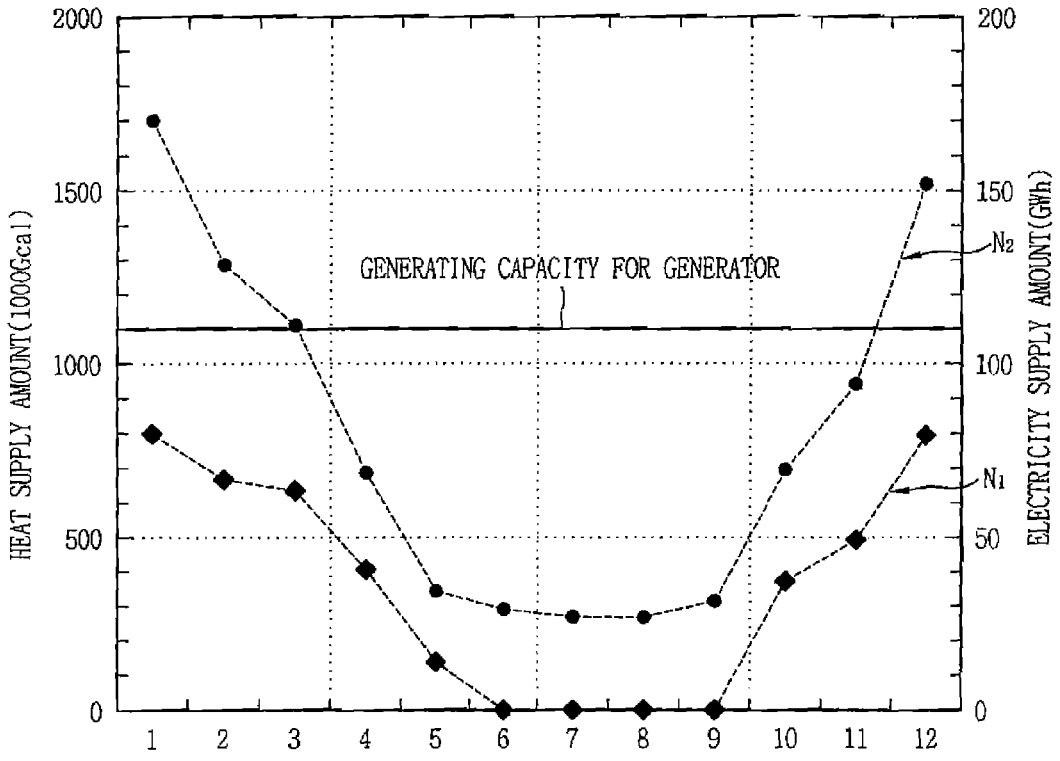
FIG. 2 RELATED ART
FIG. 2 is a graph showing monthly heat/electricity supply of a district heating corporation.
Figure 3:
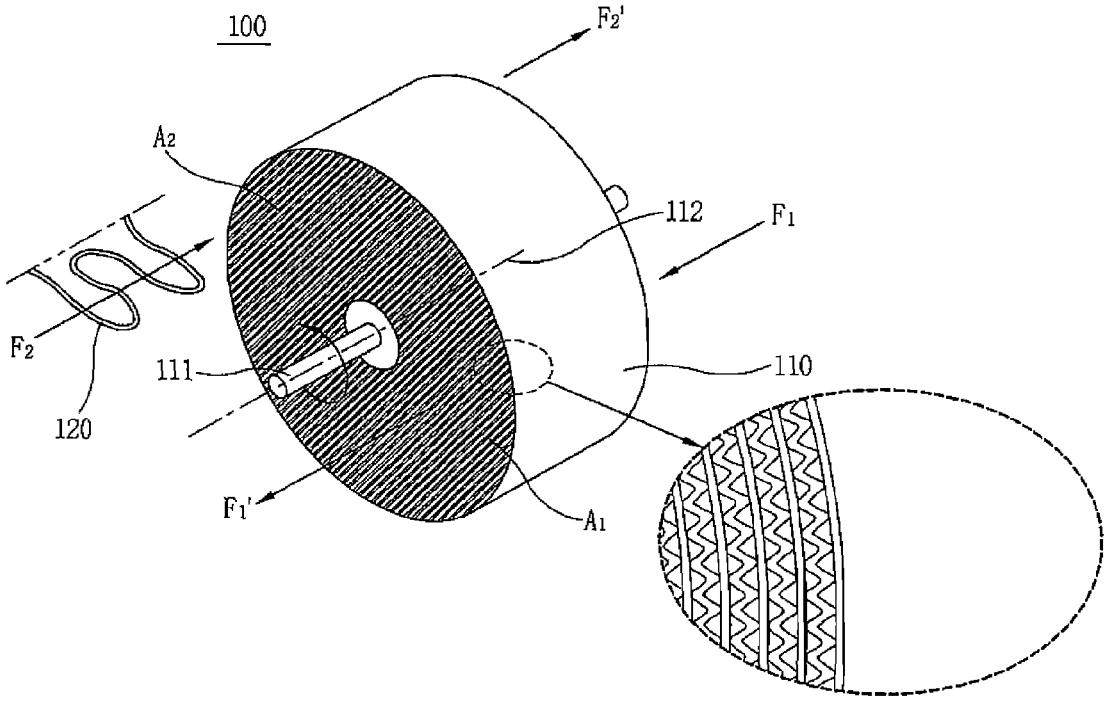
FIG. 3 is a concept view illustrating a dehumidification apparatus in accordance with one preferred embodiment of the present invention.

FIG. 3 is a concept view illustrating a dehumidification apparatus in accordance with one preferred embodiment of the present invention.

Referring to FIG. 3, the dehumidification apparatus 100 includes a desiccant rotor 110 and a regeneration unit 120.

The desiccant rotor 110 is normally formed in a cylindrical shape filled with a honeycomb structure, so that the air can pass through channels defined by the honeycomb structure. A desiccant (not shown) such as silica gel, zeolite or LiCl is coated on the walls defining the air paths through the desiccant rotor 110. The desiccant adsorbs moisture from the air passing through the desiccant rotor 110. The desiccant rotor 110 is mounted on a structure (not shown) to be rotated around a rotation shaft 111 at its center.

The regeneration unit 120 is disposed at one side of the desiccant rotor 110, for heating the air flowing toward the desiccant rotor 110. Hot water is supplied to the regeneration unit 120 to provide thermal energy to heat the air. Accordingly, the regeneration unit 120 becomes at least one of a hot water air heater. The hot water supplied to the regeneration unit can be from a district energy facility such as a cogeneration plant 500 (refer to FIG. 6), or a water heater for heating (not shown) such as a boiler.

Moreover, in order to prevent mixing of the air flows F1 and F2 flowing into first and second regions A1 and A2 of the desiccant rotor 110, respectively, a partition wall (not shown) can be installed on a imaginary line 112 dividing the first and second regions A1 and A2.

The operation of the dehumidification apparatus 100 in accordance with the present invention will now be described.

The air flow F1 flowing into the first region A1 of the desiccant rotor 110 passes through the desiccant rotor 110 through a channel formed by the honeycomb structure of the desiccant rotor 110. In this process, the desiccant coated on the desiccant rotor 110 adsorbs moisture from the air flow F1. Therefore, the air flow F1' is dehumidified and dried through the desiccant rotor 110. On the other hand, the first region A1 of the desiccant rotor 110 has high moisture uptake due to the moisture adsorption.

The air flow F2 passing through the regeneration unit 120 is heated to the regeneration temperature by the hot water flowing in the regeneration unit 120. This air flow F2 at the regeneration temperature flows into the second region A2 of the desiccant rotor 110.

Since the desiccant rotor 110 rotates around the rotation shaft 111, the part of the desiccant rotor 110 with high moisture uptake previously occupied the first region A1 turns to the second region A2. Then the moisture is desorbed by the air flow F2 having the raised temperature. As a result, the air flow F2' which has passed through the second region A2 has high humidity.

As the moisture is desorbed by the air flow F2, the second region A2 is dried again, which is called regeneration of the desiccant rotor 110. The regenerated part of the desiccant rotor 110 at the second region A2 turns to the first region A1 as the desiccant rotor 110 rotates. Accordingly, at the first region A1 the moisture is removed from the air flow F1 continuously.

In the above dehumidifying process, the air flow F2 supplied to the desiccant rotor 110 directly contacts the desiccant rotor 110 and transfers heat, thereby improving transfer efficiency. Even if the temperature of the regeneration heat source (hot water) is low, the desiccant rotor 110 is efficiently regenerated to attain a sufficient dehumidification effect.

Figure 4:
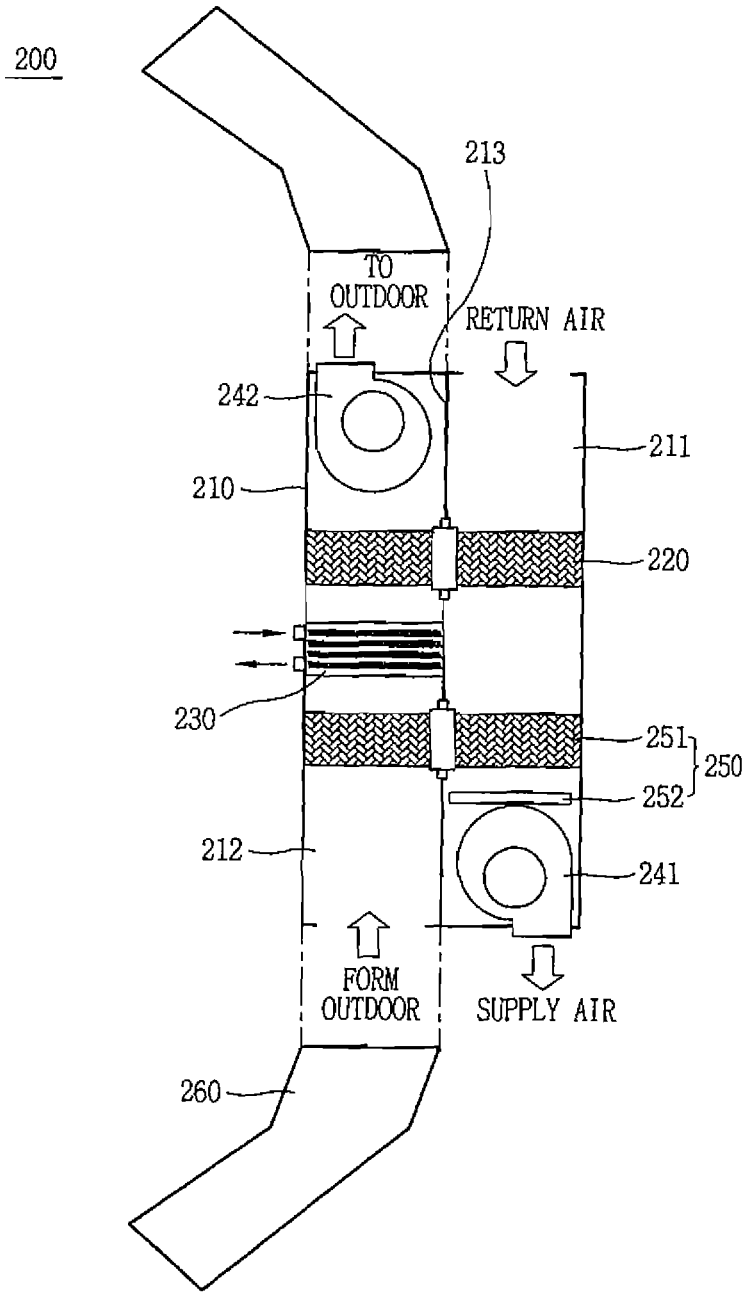
FIG. 4 is a concept view illustrating an air conditioning apparatus in accordance with another preferred embodiment of the present invention.

FIG. 4 is a concept view illustrating an air conditioning apparatus in accordance with another preferred embodiment of the present invention.

As illustrated in FIG. 4, the air conditioning apparatus 200 includes a casing 210, a desiccant rotor 220 and a regeneration unit 230.

The casing 210 encloses two channels, i.e., the first and the second channels 211 and 212. The first and second channels 211 and 212 are divided by a partition wall 213 disposed inside the casing 210. Both ends of the first and second channels 211 and 212 are opened, so that the air can flow through the first and second channels 211 and 212, respectively.

The desiccant rotor 220 and the regeneration unit 230 correspond to the desiccant rotor 110 and the regeneration unit 120, respectively, mentioned above. Detailed explanations thereof are omitted.

The desiccant rotor 220 is installed across the partition wall 213 to be placed crossing the first and second channels 211 and 212. The regeneration unit 230 is disposed inside the second channel 230. As mentioned above, the regeneration unit 230 is a hot water air heater supplied with hot water from the district energy facility or the water heater for space heating.

To facilitate the air flows passing through the first and second channels 211 and 212, first and second fans 241 and 242 can be additionally disposed in the first and second channels 211 and 212, respectively.

When the air flow which has passed through the first channel 211 is supplied to an indoor space intended to be air-conditioned, the air flow passing through the second channel 212 must be taken from an outdoor space and discharged back to the outdoor space. For this, extension ductwork 260 for connecting the second channel 212 to the outdoor space is provided with at both ends of the second channel 212.

To supply the low temperature and low humidity air into the indoor space, a cooling unit 250 is added to the dehumidification apparatus.

For example, a sensible heat rotor 251 can be used as the cooling unit 250. The sensible heat rotor 251 is made of heat absorbing material having high thermal capacity, so that the air flows flowing in the first and second channels 211 and 212 can exchange heat via the sensible heat rotor 251. The air in the first channel 211 flowing out of the desiccant rotor 220, which is increased in temperature due to the heat release from the moisture sorption process through the desiccant rotor 220, is cooled transferring heat to the sensible heat rotor 251. Then, the heated part of the heat rotor 251 rotates into the second channel 212 to release heat to the air flowing from outdoors. For this, identically to the desiccant rotor 220, the sensible heat rotor 251 is installed across the partition wall 213, and rotates over the first and second channels 211 and 212.

For further cooling, a cooling coil 252 can be installed in the first channel 211 at the outlet of the sensible heat rotor 251. The cooling coil 252 additionally cools the air which has passed through the sensible heat rotor 251 by refrigerants or chilled water.

Figure 5:
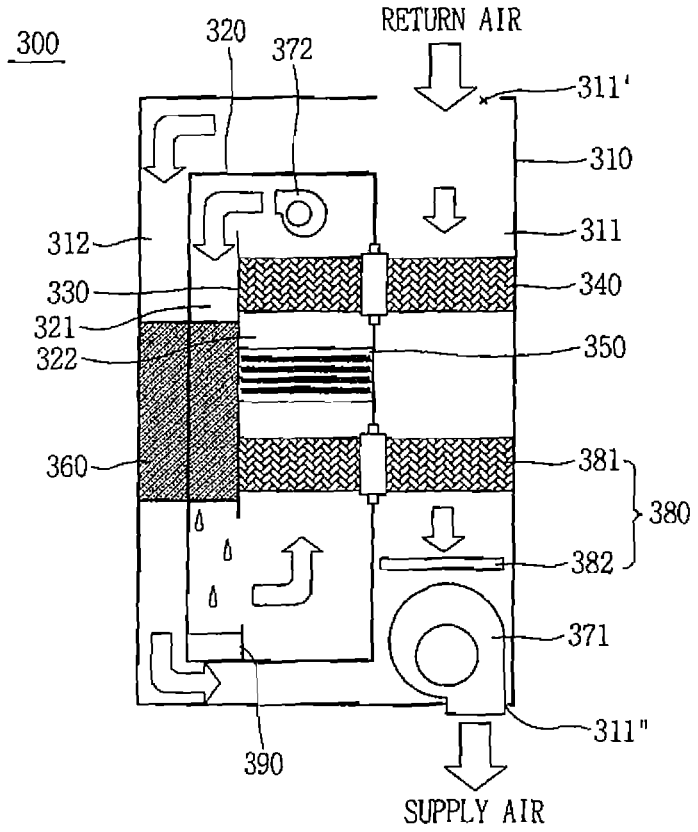
FIG. 5 is a concept view illustrating an air conditioning apparatus in accordance with yet another preferred embodiment of the present invention.

FIG. 5 is a concept view illustrating an air conditioning apparatus in accordance with yet another preferred embodiment of the present invention.

As shown in FIG. 5, the air conditioning apparatus 300 includes a first casing 310, a second casing 320, a partition wall 330, a desiccant rotor 340 and a regeneration unit 350.

The first casing 310 is a hollow body with its inlet 311' and outlet 311" opened at both ends. The inside space of the first casing 310 is divided into a first channel 311 and a second channel 312 by the second casing 320 disposed inside the first casing 310.

The second casing 320 is a blocked hollow body. The partition wall 330 is disposed inside the second casing 320. The partition wall 330 partitions off the inside space of the second casing 320 into third and fourth channels 321 and 322 in communication with each other.

The desiccant rotor 340 and the regeneration unit 350 correspond to the desiccant rotor 220 and the regeneration unit 230 explained above. Therefore, detailed explanations thereof are omitted.

As shown in FIG. 5, the air conditioning apparatus 300 includes a condensing unit 360 in addition to the second embodiment shown in FIG. 4. The condensing unit 360 condenses the moisture from the air flowing out of the desiccant rotor in the fourth or regeneration channel 322. The air flowing out of the condensing unit 360 is decreased in the humidity due to the moisture condensation and is redirected to the regeneration channel 322 of the desiccant rotor 340. With this embodiment, the regeneration air can be recycled to make the regeneration air channel in a closed circuit and the desorbed moisture from the regeneration of the desiccant rotor 340 is removed in the form of condensed liquid water by the condensing unit 360, the condensed liquid water is collected in a water tank 390 which is detachably mounted on the second casing 320.

The condensing unit 360 is a sort of heat exchanger for exchanging heat between the hot humid air from the regeneration side of the desiccant rotor and the relatively cool air branching from the return air stream through an independent air channel 312. The hot humid air from the regeneration side is cooled by the relatively cold return air resulting in the moisture condensation. Consequently, the desorbed moisture from the desiccant rotor in the regeneration side is removed from the regeneration air at the condensing unit 360.

A cooling unit 380 for cooling the air dehumidified by the desiccant rotor 340 corresponds to the cooling unit 250 described above. The dehumidified air from the desiccant rotor 340 is finally cooled by the cooling unit 380 and is supplied to an indoor space intended to be air-conditioned. Fans 371 and 372 for facilitating air flows in the casings 310 and 320 correspond to the fans 241 and 242 described above.

Differently from the air conditioning apparatus 200, the air conditioning apparatus 300 recycles the air in the second casing or regeneration circuit 320, and thus does not need to induce the outdoor air. When the air conditioning apparatus 300 is disposed indoors, the indoor air is taken through the inlet 311' and discharged to the indoor space through the outlet 311". That is, induction of the outdoor air is not required. As a result, holes are not bored through an outer wall of a building in the installation of the air conditioning apparatus 300. In addition, as compared with the air conditioning apparatus 200, the air conditioning apparatus 300 does not require the extension channel or ductwork 260. Accordingly, the air conditioning apparatus 300 can be easily installed and disassembled.

Figure 6:
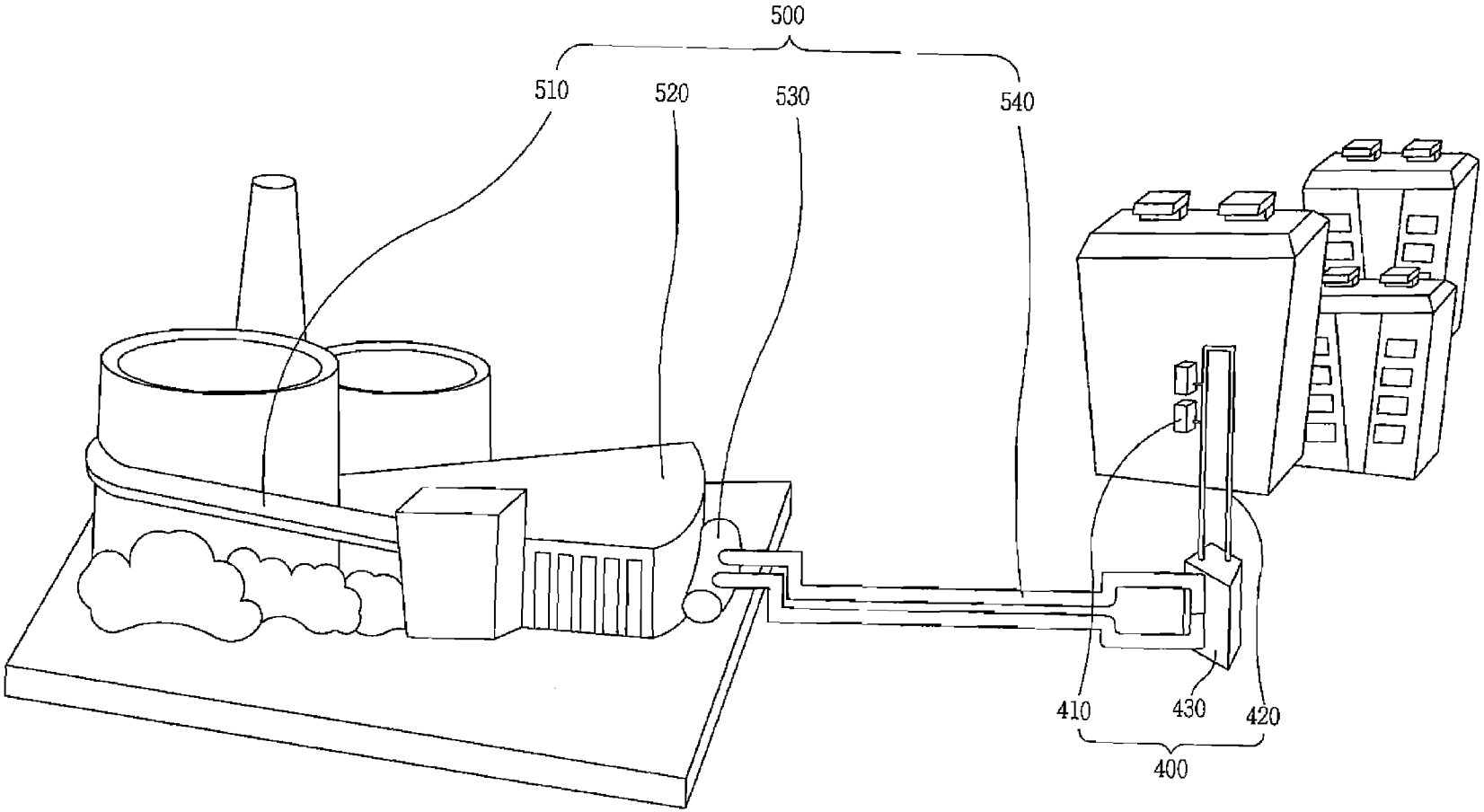
FIG. 6 is a concept view illustrating a cooling process of houses by using the district heat supply.

FIG. 6 is a concept view illustrating an air conditioning system using the district heat supply.

Referring to FIG. 6, the air conditioning system includes a dehumidification system 400 and a district heat supply system 500.

The dehumidification system 400 is composed of a dehumidification or air conditioning apparatus 410, a hot water circuit 420 and a heat exchanger 430.

The dehumidification or air conditioning apparatus 410 installed in indoor space (house, workroom, etc.) is one of the dehumidification apparatus 100 and the air conditioning apparatuses 200 and 300 for supplying the dehumidified (and cooled) air to the space requiring air-conditioning. Such apparatuses 100, 200 and 300 have been described above.

The dehumidification or air conditioning apparatus 410 is connected to the hot water circuit 420 to be supplied with the regeneration heat for the desiccant rotor 110, 220 or 340. The heat exchanger 430 transfers heat from the district heat supply system 500 to the hot water circuit 420.

The district heat supply system 500 is a central energy facility such as a cogeneration plant. The cogeneration plant 500 stores waste heat generated by electricity generation in a thermal storage tank 510. A heat exchanger 520 performs heat exchange with water. The water supplied with heat moves along a heat transfer line 540 connected to the heat exchanger 430 by a circulation pump 530.

By this configuration, the waste heat can be supplied from the district heat supply system 500 to each space requiring air-conditioning, and used to dehumidify and cool the air. With this increased heat demand to supply air-conditioning in the summer, it is possible to operate the cogeneration plant 500 even in the summer which has not been normally managed due to large decrease in the heat demand in summer.

Another advantage of the present invention is that any additional installation of the water lines is not required for the embodiment of the present invention except the original hot water circuit for heating. It is thus possible to efficiently economically use the waste heat for air conditioning.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An air conditioning apparatus, comprising:

a first hollow casing having an inlet and an outlet;

a second hollow casing disposed in the first casing, to partition off the first casing into first and second channels in communication with each other and to provide a closed inner space;

a partition wall formed in the second casing, to partition off the second casing into third and fourth channels in communication with each other;

a desiccant rotor rotatably provided to cross paths of the first and fourth channels and absorb moisture from air flowing into the first channel;

a regeneration unit provided to cross a path of the fourth channel and heat air flowing into the fourth channel to desorb the moisture adsorbed to the desiccant rotor;

a sensible heat rotor rotatably provided to cross the paths of the first and fourth channels to cool the air passing through the desiccant rotor by heat exchange with air of the fourth channel; and a heat exchanger provided to cross at least one of a path of the second channel and a path of the third channel to exchange heat between air flowing in the second channel and/or an air flowing into the third channel;

wherein the regeneration unit comprises at least one channel to receive heated water from a district heating system for multiple residences.

2. The air conditioning apparatus as claimed in claim 1, further comprising at least one fan disposed in at least one of the first and fourth channels to increase an air flow of at least one of the first and fourth channels.

3. The air conditioning apparatus as claimed in claim 1, further comprising a cooling unit to cool the air dried through the desiccant rotor.

4. The air conditioning apparatus as claimed in claim 3, wherein the cooling unit comprises the sensible heat rotor rotatably provided to cross the paths of the first and fourth channels.

5. The air conditioning apparatus as claimed in claim 4, wherein the sensible heat rotor is made of metal having high heat conductivity.

6. The air conditioning apparatus as claimed in claim 3, wherein the cooling unit comprises a cooler to contain a refrigerant to exchange heat with the air passing through the desiccant rotor.

7. The air conditioning apparatus as claimed in claim 3, further comprising a water tank detachably provided to store water condensed in the heat exchanger.

* * * * *